US006296527B1

(12) United States Patent
Zhang et al.

(10) Patent No.: US 6,296,527 B1
(45) Date of Patent: Oct. 2, 2001

(54) MODULAR JACK CONNECTOR

(75) Inventors: Jianqiang Zhang; ZhengHua Xu, both of Kunshan; ZiQiang Zhu, Kushan, all of (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/517,219

(22) Filed: Mar. 2, 2000

(30) Foreign Application Priority Data

Jan. 25, 2000 (TW) ..... 089201285

(51) Int. Cl.[7] ..... H01R 23/02
(52) U.S. Cl. ..... 439/676
(58) Field of Search ..... 439/676, 701

(56) References Cited

U.S. PATENT DOCUMENTS 5,697,817 * 12/1997 Bouchan et al. ..... 439/676
5,759,070 * 6/1998 Belopolsky ..... 439/676
5,879,199 * 3/1999 Belopolsky ..... 439/676
5,957,730 * 9/1999 Wang ..... 439/676
6,019,641 * 2/2000 Kan ..... 439/676
6,080,011 * 6/2000 Tsao et al. ..... 439/676
6,086,429 * 7/2000 Wu ..... 439/676

* cited by examiner

*Primary Examiner*—Gary F. Paumen
(74) *Attorney, Agent, or Firm*—Wei Te Chung

(57) ABSTRACT

An electrical connector comprises an insulative housing and a contact module. The contact module in the shape of the letter L includes a plurality of contacts and a contact fixing block, the contacts being insert molded into the contact fixing block. The contact fixing block includes a vertical portion and a horizontal portion extending from a lower end of the vertical portion. The contacts each include solder tail downwardly extending from a bottom face of the contact fixing block in two rows. The area of the bottom of the contact fixing block is comparatively large, thus the solder tails can be positioned in a large range for meeting different layout requirements of PCBs.

1 Claim, 4 Drawing Sheets

MODULAR JACK CONNECTOR

BACKGROUND OF THE INVENTION

1. Field of the Invention

The present invention relates to a connector, and particularly to a modular jack connector having an improved configuration regarding the contact fixing block so that solder tails of the contacts of the modular jack connector can be positioned within a relatively large area to meet the requirements of different printed circuit board (PCB) layouts.

2. Description of Prior Art

U.S. Pat. No. 5,697,817 discloses a prior art modular jack connector that comprises a contact module 1' as shown in FIGS. 4–5. The contact module 1' includes a plurality of contacts 11' which are insert molded into a rectangular contact fixing block 12'. Each contact 11' includes a spring beam contact portion 111', a curved portion 112'a body portion (not shown) received in the contact fixing block 12' and a solder tail 113'. Each spring beam contact portion 111' extends from the curved portion 112' at a fixed angle and extends outward in cantilever fashion. The spring beam contact portions 111' are arranged in a row. The solder tails 113' downwardly extend from a bottom face 114' of the contact fixing block 12' for being inserted through holes in a PCB and soldered thereto.

In the disclosed prior art, the solder tails 113', as shown, extend beyond the relatively small bottom face 114' of the rectangular contact fixing block 12'. This means that the position of the solder tails 113' is confined within a quite small range, which is unfavorable for meeting different PCB layouts developed by different manufactures. Hence, an improved electrical connector having an improved contact fixing block configuration is required to overcome the disadvantages of the prior art.

SUMMARY OF THE INVENTION

An object of the present invention is to provide an electrical connector having a contact fixing block with an improved configuration so that solder tails of the contacts of the modular jack connector can be positioned within a relatively large range to meet the requirements of different PCB layouts.

A connector in accordance with the present invention comprises a contact module, an insulative housing and a shell (not shown) enclosing the assembly of the housing and the contact module. The contact module includes a plurality of contacts and a contact fixing block in the shape of the letter L, the contacts being insert molded into the contact fixing block. Each contact includes a spring beam contact portion, a curved portion, a horizontal portion, a body portion and a solder tail. The contact fixing block includes a vertical portion and a horizontal portion extending from a lower end of the vertical portion. The vertical portion forms a pair of protrusions on its lateral sides and two opposite stepped sections below the protrusions. The horizontal portion forms a pair of posts at a front end thereof. The solder tails downwardly extend from the bottom face of the contact fixing block in two parallel rows. The area of the bottom face of the contact fixing block is the sum of the areas of bottom faces of the vertical portion and the horizontal portion, which sum is relatively large compared to that of the rectangular contact fixing block disclosed in the prior art. Therefore, the solder tails of the contacts can be positioned in a relatively large area while still being effectively retained in the contact fixing block. This is very advantageous since, when a PCB layout is changed, only the solder tails need to be modified; the configuration of the contact fixing block does not need to be modified.

Other objects, advantages and novel features of the invention will become more apparent from the following detailed description of the present embodiment when taken in conjunction with the accompanying drawings.

DESCRIPTION OF THE INVENTION

Figure 1:
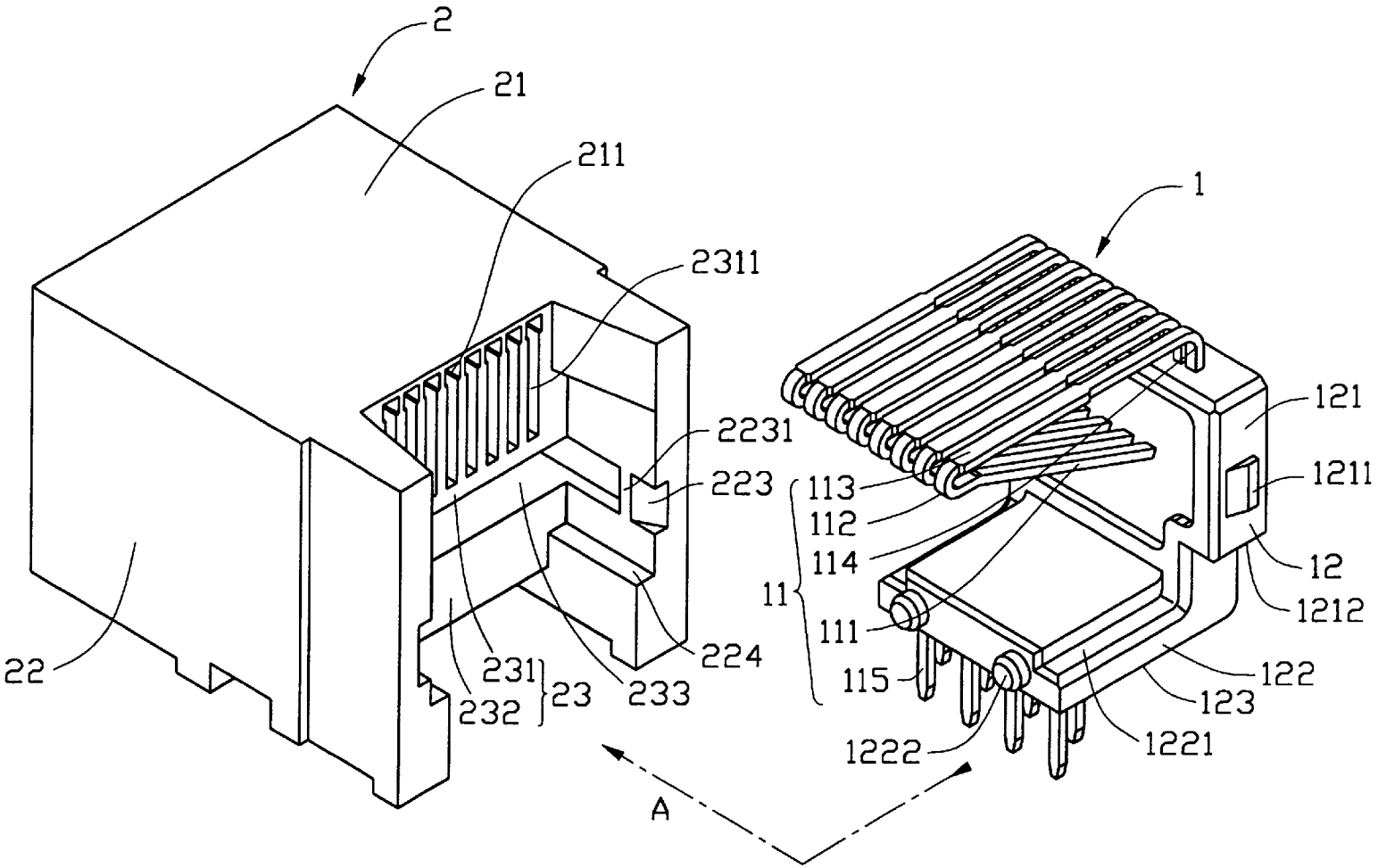
FIG. 1 is an exploded view of an electrical connector in accordance with the present invention.

Referring to FIG. 1, an electrical connector in accordance with the present invention comprises a contact module 1, an insulative housing 2 and a shell (not shown) enclosing an assembly of the housing 2 and the contact module 1. The contact module 1 includes a plurality of contacts 11, and an insulative contact fixing block 12. The contacts 11 are insert molded into the insulative contact fixing block 12. The contact module 1 is assembled into the housing 2 in the direction of arrow A.

Figure 3:
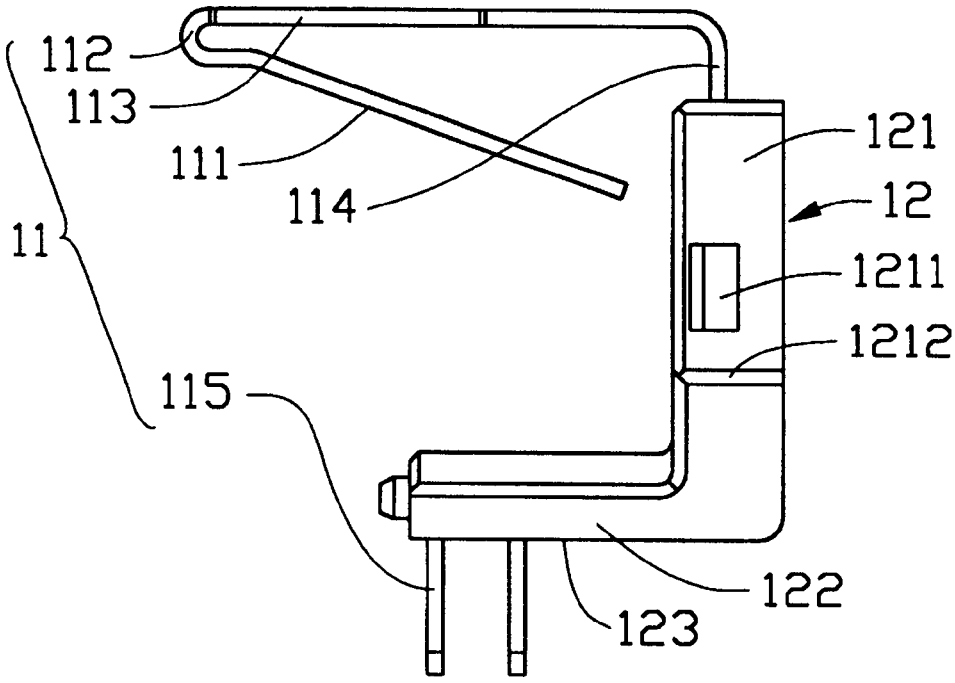
FIG. 3 is a side view of a contact module of FIG. 1.
Figure 4:
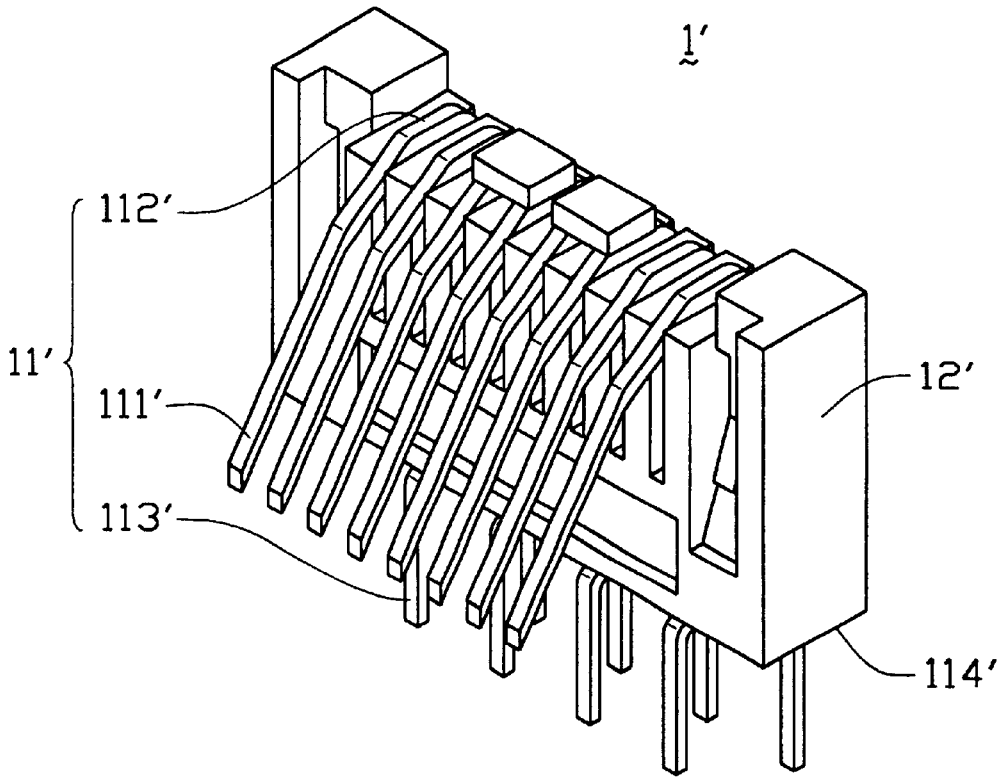
FIG. 4 (PRIOR ART)
FIG. 4 is a perspective view of a prior art contact module.
Figure 5:
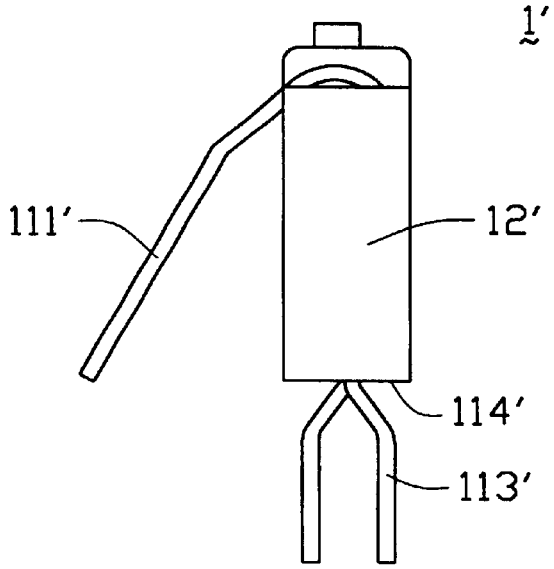
FIG. 5 (PRIOR ART)
FIG. 5 is a side view of the contact module of FIG. 4.

Referring to FIG. 1 in conjunction with FIG. 3 each contact 11 includes a spring beam contact portion 111, a curved portion 112, a horizontal portion 113, a body portion 114 and a solder tail 115. The spring beam contact portion 111 extends from a lower end of the curved portion 112 towards the contact fixing block 12 at a fixed angle and in cantilever fashion. The contact portions 111 are arranged in a row. The horizontal portion 113 horizontally extends from an upper end of the curved portion 112 and towards the contact fixing block 12. The body portion 114 is largely received in the contact fixing block 12. The solder tail 115 downwardly extends from a bottom face 123 of the contact fixing block 12 for insertion through a hole in a PCB and soldering thereto. The solder tails 115 are in two parallel rows. The contact fixing block 12 is in the shape of the letter L and includes a vertical portion 121 and a horizontal portion 122 horizontally extending from a lower end of the vertical portion 121. The vertical portion 121 has two opposite sidewalls each forming a protrusion 1211 thereon and a stepped section 1212 below the protrusion 1211. The protrusions 1211 and the stepped sections 1212 are used for positioning and locking the contact module 1 in the housing 2. The horizontal portion 122 defines a pair of recesses 1221 in its opposite lateral sides and forms a pair of cylindrical posts 1222 at a front end thereof. Because the contact fixing block 12 is L-shaped, the area of the bottom face 123 of the contact fixing block 12 is the sum of the areas of the bottom faces of the vertical portion 121 and the horizontal portion 122, which sum is relatively large compared to the area of the bottom face 114' of the prior art rectangular contact fixing block 12'. Thus, the solder tails 115 of the contacts 11 can be positioned in a relatively large area to meet the requirements of different PBC layouts, while still being effectively retained in the contact fixing block 12. This is very advantageous since, when a PCB layout is changed, only the solder tails need to be modified, the configuration of the contact fixing block 12 does not need to be modified.

Figure 2:
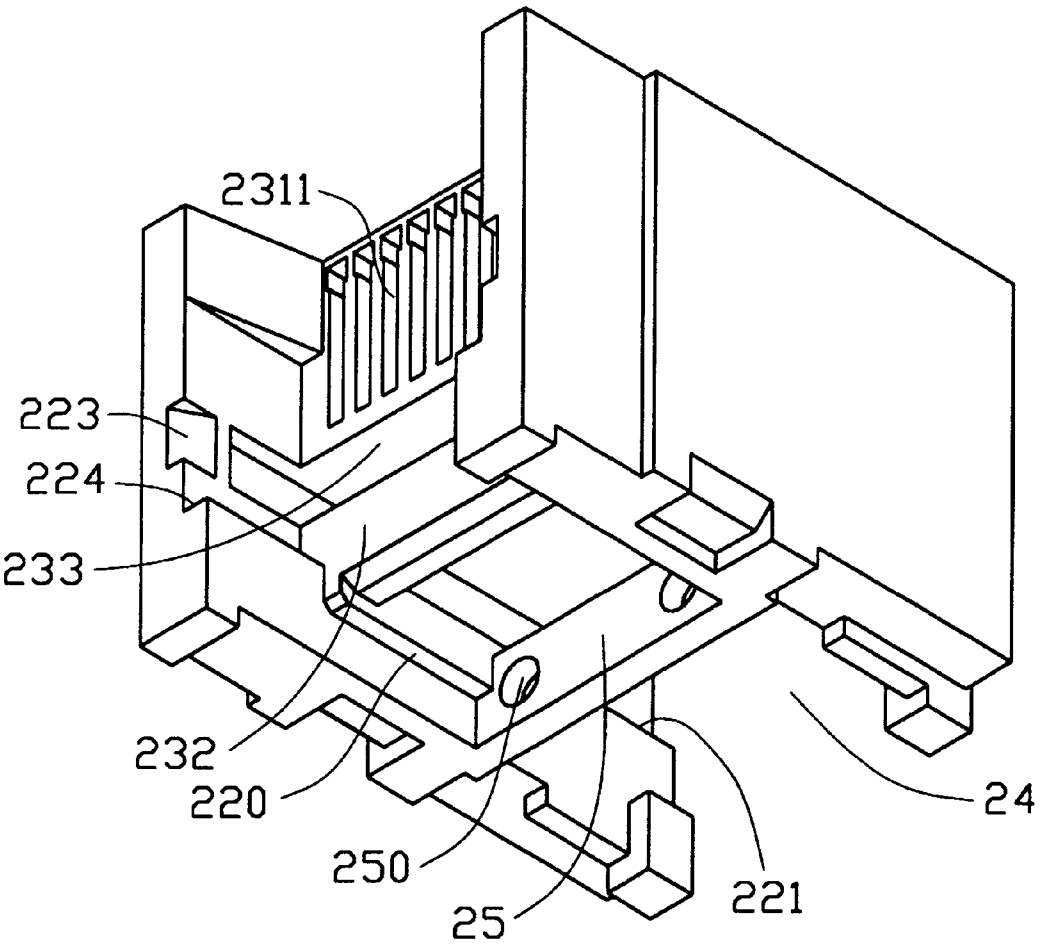
FIG. 2 is a perspective view of a housing of FIG. 1 seen from rear and bottom sides thereof.

Referring to FIG. 1 in conjunction with FIG. 2, the housing 2 includes a top wall 21, a pair of opposite sidewalls 22 and a rear wall 23. Within these walls is a plug-receiving cavity 24 for receiving a modular plug (not shown). Each sidewall 22 forms a front rail 221 on a lower interior surface thereof which rearwardly extends to the rear wall 23 for guiding entrance of a modular plug into the cavity 24. The sidewall 22 define a pair of opposite recessed portions 223 on rear interior sides thereof for guiding the protrusions 1211 of the vertical portion 121 into the housing 2, and a pair of rear supports 224 also at the rear interior sides thereof for supporting the stepped sections 1212 of the vertical portion 121 of the contact fixing block 12. A beam 25 is formed between the front rails 221 and is located in front of the rear wall 23 and defines a pair of circular depressions 250 in a rear surface thereof for engaging with the posts 1222 of the horizontal portion 122. The rear wall 23 includes an upper portion 231 and a lower portion 232 separated from the upper portion 231 by a slot 233. The slot 233 extends into the interior surface of both sidewalls 22 and is separated from the pair of recessed portions 223 by a pair of blockages 2231 formed in the sidewalls 22. The upper portion 231 defines a plurality of contact passageways 2311 therethrough, each passageway 2311 having an enlarged upper part 211. An extending portion 220 downwardly extends from each rail 221 and is located between the lower portion 232 of the rear wall 23 and the beam 25.

The contact module 1 is assembled into the housing 2 from a rear portion of the housing 2, the horizontal portions 113 of the contacts 11 being received in the upper parts 211 of the contact passageways 2311, the spring beam contact portions 111 of the contacts 11 extending through the ontact passageways 2311 and being exposed to the plug-receiving cavity 24 for electrical connection with terminals of the modular plug, the stepped sections 1212 of the vertical portion 121 being supported on the rear supports 224 of the sidewalls 22, the recesses 1221 of the horizontal portion 122 fittingly receiving the extending portions 220, the posts 1222 of the horizontal portion 122 being received in the depressions 250 of the beam 25, and the protrusions 1211 passing through the recessed portions 223 to be received in the slot 233 and to firmly engage with the blockages 2231 formed between the slot 233 and the recessed portions 223.

By the design of the posts 1222 fitting with the beam 25, the horizontal portion 122 of the contact fixing block 12 can be securely mounted and accurately positioned, after the housing 2 and the contact module 1 have been assembled together. This, in turn, provides the connector in accordance with the present invention with greater integrity and improves the precision of solder tail positioning.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a top wall, a pair of sidewalls and a rear wall and forming a cavity within the walls for receiving a modular plug; and a contact module being secured in the insulative housing from a rear side of the housing and comprising a contact fixing block and a plurality of contacts being insert molded into the contact fixing block, the contact fixing block including a vertical portion, and a horizontal portion forwardly and horizontally extending from a lower end of the vertical portion, the contacts including solder tails downwardly extending from a bottom face of the contact fixing block for soldering to a PCB and spring beam contact portions extending in assembly through the rear wall into the cavity of the insulative housing;

wherein the vertical portion forms a stepped section on each side thereof, and wherein each sidewall of the housing forms a rear support at the rear side thereof for supporting the stepped section;

wherein the horizontal portion forms a pair of recesses in its lateral sides, and wherein each side wall of the housing forms a front rail forming an extending portion fittingly received in the recesses for positioning the contact module in the housing;

wherein the vertical portion has two opposite sidewalls each forming a protrusion thereon, and wherein each sidewall of the housing forms a recessed portion and a blockage, with the protrusion passing through the recessed portion and firmly engaging with the blockage;

wherein the horizontal portion forms fixing devices at a front end thereof, and wherein a beam formed between the sidewalls of the housing has means for engaging with the fixing devices;

wherein the fixing devices of the horizontal portion is a post, and wherein the means for engaging with the fixing devices is a depression defines in a rear face of the beam;

wherein the beam is located in front of the rear wall and between the sidewalls of the housing.

* * * * *